US007821485B2

(12) United States Patent
Kim

(10) Patent No.: US 7,821,485 B2
(45) Date of Patent: Oct. 26, 2010

(54) SOURCE DRIVER OUTPUT CIRCUIT OF THIN FILM TRANSISTOR LIQUID CRYSTAL DISPLAY

(75) Inventor: Ki-joon Kim, Suwon (KR)

(73) Assignee: Samsung Electronics Co., Ltd. (KR)

( * ) Notice: Subject to any disclaimer, the term of this patent is extended or adjusted under 35 U.S.C. 154(b) by 920 days.

(21) Appl. No.: 11/245,279

(22) Filed: Oct. 6, 2005

(65) Prior Publication Data

US 2006/0071898 A1 Apr. 6, 2006

Related U.S. Application Data

(63) Continuation-in-part of application No. 10/283,974, filed on Oct. 30, 2002, now Pat. No. 6,954,192.

(30) Foreign Application Priority Data

Jan. 30, 2002 (KR) ..... 2002-0005420

(51) Int. Cl.
*G09G 3/36* (2006.01)

(52) U.S. Cl. ..... 345/100; 349/41

(58) Field of Classification Search ..... 345/211, 345/204, 89, 50, 52, 87, 92, 100, 104; 349/42
See application file for complete search history.

(56) References Cited

U.S. PATENT DOCUMENTS

| | | | | |
|---|---|---|---|---|
| 5,414,443 | A * | 5/1995 | Kanatani et al. | 345/95 |
| 5,583,531 | A | 12/1996 | Okada et al. | 345/89 |
| 5,621,426 | A | 4/1997 | Okada et al. | 345/95 |
| 5,635,950 | A | 6/1997 | Okada et al. | 345/95 |
| 5,686,933 | A | 11/1997 | Okada et al. | 345/95 |
| 6,310,616 | B1 * | 10/2001 | Yanagi et al. | 345/211 |
| 6,396,485 | B1 | 5/2002 | Minami | 345/204 |
| 6,529,180 | B1 * | 3/2003 | Ito et al. | 345/89 |
| 6,697,038 | B2 | 2/2004 | Morii | 345/96 |
| 6,731,266 | B1 | 5/2004 | Jung | |
| 6,762,737 | B2 | 7/2004 | Kajihara et al. | 345/89 |
| 6,954,192 | B2 * | 10/2005 | Kim | 345/87 |

(Continued)

FOREIGN PATENT DOCUMENTS

JP 09-230829 9/1997

(Continued)

*Primary Examiner*—Amare Mengistu
*Assistant Examiner*—Vinh T Lam
(74) *Attorney, Agent, or Firm*—Mills & Onello, LLP

(57) ABSTRACT

A source driver output circuit of a thin film transistor (TFT) liquid crystal display (LCD) includes first through n-th voltage generators, first through n-th switching portions, first through n-th sub switching portions, and a switching circuit. The voltage generators receive first through n-th corresponding input voltages and generate first through n-th sub input voltages. The switching portions generate the sub input voltages as first through n-th corresponding output voltages when activated, or cut off the sub input voltages when deactivated. The sub switching portions connect predetermined share lines to the output voltages when activated, or cut off the predetermined share lines when deactivated. The switching circuit maintains each of the share line voltages equally at an intermediate voltage level that is between the share line voltages. Therefore, the slew rate of a signal input to the panel from the source driver can be improved, and current consumption in the source driver can be reduced.

12 Claims, 6 Drawing Sheets

U.S. PATENT DOCUMENTS

| | | | | |
|---|---|---|---|---|
| 7,046,223 | B2 * | 5/2006 | Hashimoto | 345/89 |
| 2001/0048415 | A1 | 12/2001 | Morii | 345/87 |
| 2002/0003242 | A1 | 1/2002 | Uchiyama | 257/200 |
| 2002/0024486 | A1 | 2/2002 | Aoki | 345/87 |
| 2002/0033804 | A1 | 3/2002 | Liang et al. | 345/173 |
| 2003/0006801 | A1 | 1/2003 | Brownlow et al. | 326/81 |
| 2003/0142050 | A1 | 7/2003 | Kim | 345/87 |

FOREIGN PATENT DOCUMENTS

| | | | |
|---|---|---|---|
| JP | 10-187100 | | 7/1998 |
| JP | 2000089194 | | 3/2000 |
| JP | 2001-22328 | | 1/2001 |
| JP | 2001022328 | A * | 1/2001 |

* cited by examiner

SOURCE DRIVER OUTPUT CIRCUIT OF THIN FILM TRANSISTOR LIQUID CRYSTAL DISPLAY

CROSS REFERENCE TO RELATED APPLICATION

This application is a Continuation-In-Part of U.S. patent application Ser. No. 10/283,974, entitled "SOURCE DRIVER OUTPUT CIRCUIT OF THIN FILM TRANSISTOR LIQUID CRYSTAL DISPLAY," filed on Oct. 30, 2002, now U.S. Pat. No. 6,954,192 which, in turn, claims priority under 35 U.S.C. §119 to Korean Patent Application No. 02-05420, filed on Jan. 30, 2002, the contents of each being incorporated herein by reference, in their entirety for all purposes.

BACKGROUND OF THE INVENTION

1. Field of the Invention

The present invention relates to a thin film transistor (TFT) liquid crystal display (LCD), and more particularly, to a source driver output circuit for a TFT LCD.

2. Description of the Related Art

In order to drive a panel of a thin film transistor (TFT) liquid crystal display (LCD), the TFT LCD generally includes a gate driver for driving gate lines (alternatively referred to as row lines) of the TFT and a source driver for driving source lines (alternatively referred to as column lines) of the TFT. If the gate driver applies a high voltage to the TFT LCD, and thereby the TFT is turned on, the source driver applies source drive signals for indicating colors to source lines, respectively and thereby an image screen is displayed on the LCD.

FIG. 1 illustrates a conventional source driver output circuit. Referring to FIG. 1, an output circuit 100 of a source driver receives an input voltage INP1 so as to supply source drive signals for indicating colors to a panel (not shown). In such a case, an input voltage INP1 having a high level is input once, and an input voltage INP1 having a low voltage is input once. That is, an input voltage INP1, having a voltage higher than a reference voltage, is input once, and an input voltage INP1, having a voltage lower than the reference voltage, is input once on the basis of a predetermined reference voltage. The input voltage INP1 input to the source driver output circuit 100 is applied to a voltage generator 110, for example comprising a voltage follower. The input voltage INP1 input to the source driver output circuit 100 usually contains a relatively small amount of current, and thus is converted into a voltage having a larger amount of current at the same voltage level by the voltage follower 110.

A voltage output from the voltage follower 110 passes through a switch 120 and is generated as an output voltage OUT1. In this case, the switch 120 is turned off so that the input voltage INP1 is not output during the short time duration during which the level of the input voltage INP1 is varied. If the level of the input voltage INP1 is rapidly varied, then the output voltage OUT1 is rapidly varied. This variation affects the quality of images produced on the panel (not shown), for example causing noise or trembling in the images. In order to prevent noise or trembling in images, the switch 120 is turned off for the short time period during which the level of the input voltage INP1 is varied.

The switch 120 is comprised of a PMOS transistor that is turned on or off by applying a control signal SW1 to a gate thereof, and a NMOS transistor that is turned on or off by applying an inverted control signal SWB1 to a gate thereof.

FIG. 2 is a timing diagram illustrating the operation of the source driver output circuit of FIG. 1. Referring to FIG. 2, the control signal SW1 transitions to a high level during the time period in which the level of the input voltage INP1 is varied. When the control signal SW1 is at a high level during interval H-Z, the switch 120 is turned off, and thus, the input voltage INP1 is not generated as the output voltage OUT1. An oblique portion of the waveform of the output voltage OUT1 during this time span represents a high-impedance state.

FIG. 3 illustrates modeling of a panel of a thin film transistor (TFT) liquid crystal display (LCD) that is connected to an output voltage OUT1. Referring to FIG. 3, a panel 300 is comprised of resistors R1, R2, and R3, and capacitors C1, C2, and C3. The respective resistors R1, R2, and R3 have different resistance values, and the respective capacitors C1, C2, and C3 have different capacitance values.

The input voltage INP1 input to the panel 300 is distributed to charge the capacitors C1, C2, and C3 according to the different resistance values of the resistors R1, R2, and R3, and the different capacitance values of the capacitors C1, C2, and C3.

However, it is a common goal among TFT LCD designs to reduce current consumption and to generate a fast slew rate. Various methods are employed to address this issue, and one of the methods employed distributes charges to a panel by using a share line while the switch 120 is deactivated.

SUMMARY OF THE INVENTION

To address the above limitations, it is an object of the present invention to provide a source driver output circuit that is capable of reducing current consumed in a source driver of a thin film transistor liquid crystal display (LCD) and capable of improving the slew rate of a voltage that is input to a panel.

Accordingly, to achieve the above object, according to one aspect of the present invention, there is provided a source driver output circuit of a thin film transistor (TFT) liquid crystal display (LCD). The source driver output circuit includes first through n-th voltage generators, first through n-th switching portions, first through n-th sub switching portions, and a switching circuit. The first through n-th (for example, where n is even integer) voltage generators receive first through n-th corresponding input voltages and generate first through n-th sub input voltages. The first through n-th switching portions transfer the first through n-th sub input voltages as first through n-th corresponding output voltages when activated, and disconnect the first through n-th sub input voltages when deactivated. The first through n-th sub switching portions connect first and second share lines to the first through n-th output voltages when activated, and disconnect the first and second share lines when deactivated. The first and second share lines have share line voltages. The switching circuit maintains each of the share line voltages equally at an intermediate voltage level that is between the share line voltages.

In one embodiment, odd-numbered output voltages among the first through n-th output voltages are connected to the first share line via odd-numbered sub switching portions, when activated, and even-numbered output voltages among the first through n-th output voltages are connected to the second share line via even-numbered sub switching portions.

In another embodiment, the source driver output circuit further comprises a voltage-generating portion that receives a first voltage and a second voltage and applies the first voltage and the second voltage to the first and second share lines, respectively. The voltage-generating portion includes a first precharge voltage-generating portion that receives the first voltage, generates a first precharge voltage, and applies the first precharge voltage to the first share line, and the voltage-generating portion includes a second precharge voltage-generating portion that receives the second voltage, generates a second precharge voltage, and applies the second precharge voltage to the second share line.

In another embodiment, the first precharge voltage-generating portion comprises a first sub voltage generator that receives the first voltage and generates a first sub voltage, and a first precharge switch coupled between the first sub voltage generator and the first share line. The first precharge switch outputs the first sub voltage as the first precharge voltage when activated, and disconnects the first sub voltage when deactivated. The first precharge switch is activated when odd-numbered switching portions of the first through n-th switching portions are deactivated.

In another embodiment, the first precharge voltage-generating portion applies a first predetermined external voltage to a first node between the first precharge switch and the first share line, and the first external voltage has a predetermined level. The first predetermined external voltage is applied when the first precharge switch is deactivated.

In another embodiment, the first sub voltage generator is in the form of a voltage follower. The first voltage has a predetermined level, and the level of the first voltage is varied, when the levels of odd-numbered input voltages among the first through n-th input voltages are varied.

In another embodiment, the second precharge voltage-generating portion comprises a second sub voltage generator that receives the second voltage and generates a second sub voltage, and comprises a second precharge switch coupled between the second sub voltage generator and the second share line. The second precharge switch outputs the second sub voltage as the second precharge voltage when activated, and disconnects the second sub voltage when deactivated. The second precharge switch is activated when even-numbered switching portions of the first through n-th switching portions are deactivated.

In another embodiment, the second precharge voltage-generating portion applies a second predetermined external voltage to a second node between the second precharge switch and the second share line, the second external voltage having a predetermined voltage level. The second external voltage is applied when the second precharge switch is deactivated. The second sub voltage generator comprises an amplifier in the form of a voltage follower. The second voltage has a predetermined level, and the level of the second voltage is varied when the levels of even-numbered input voltages among the first through n-th input voltages are varied. The first through n-th sub switching portions are activated when the first through n-th corresponding switching portions are deactivated.

In another embodiment, the switching circuit comprises a first switch, a first capacitor, a second switch, and a second capacitor. The first switch has a first node coupled to the first share line and a second node coupled to the second share line. The first capacitor is coupled between a third node of the first switch and a reference voltage. The second switch has a first node coupled to the first share line and a second node coupled to the second share line. The second capacitor is coupled between a third node of the second switch and the reference voltage.

In another embodiment, the first and third nodes of the first switch are connected, and a current path is formed between the first capacitor and the first share line, when the first switch is in a first position. The second and third nodes of the first switch are connected, and a current path is formed between the first capacitor and the second share line, when the first switch is in a second position. The first and third nodes of the second switch are connected, and a current path is formed between the second capacitor and the second share line, when the second switch is in a first position. The second and third nodes of the second switch are connected, and a current path is formed between the second capacitor and the first share line, when the second switch is in a second position.

In another embodiment, the switching circuit comprises a first switch, a first capacitor, a second switch, a second capacitor, a third switch, and a fourth switch. The first switch is coupled between the first share line and a first node. The first capacitor is coupled between the first node and a reference voltage. The second switch is coupled between the second share line and a second node. The second capacitor is coupled between the second node and the reference voltage. The third switch is coupled between the first node and the second share line. The fourth switch is coupled between the second node and the first share line. A current path is formed between the first capacitor and the first share line when the first switch is in a closed position. A current path is formed between the first capacitor and the second share line when the third switch is in a closed position. A current path is formed between the second capacitor and the second share line when the second switch is in a closed position. A current path is formed between the second capacitor and the first share line when the fourth switch is in a closed position. The third and fourth switches are in an open position when the first and second switches are in a closed position. The third and fourth switches are in the closed position when the first and second switches are in the open position.

According to another aspect of the present invention, there is provided a source driver output circuit of a thin film transistor (TFT) liquid crystal display (LCD). The source driver output circuit comprises first through n-th voltage generators, first through n-th switching portions, first through n-th sub switching portions, a voltage-generating portion, and a share-line voltage circuit. The first through n-th voltage generators receive first through n-th corresponding input voltages and generate first through n-th sub input voltages. The first through n-th switching portions transfer the first through n-th sub input voltages as first through n-th corresponding output voltages when activated, and disconnect the first through n-th sub input voltages when deactivated. The first through n-th sub switching portions connect share lines to the first through n-th output voltages when activated, and disconnect the share lines when deactivated. The share lines include first and second share lines. The voltage-generating portion receives first and second voltages and applies the first and second voltages to the first and second share lines as share line voltages. The share-line voltage circuit maintains each of the share line voltages equally at an intermediate voltage level that is between the share line voltages.

In one embodiment, the share-line voltage circuit comprises a first switch, a first capacitor, a second switch, and a second capacitor. The first switch has a first node coupled to the first share line and a second node coupled to the second share line. The first capacitor is coupled between a third node of the first switch and a reference voltage. The second switch has a first node coupled to the first share line and a second node coupled to the second share line. The second capacitor is coupled between a third node of the second switch and the reference voltage.

In another embodiment, the first and third nodes of the first switch are connected, and a current path is formed between the first capacitor and the first share line when the first switch is in a first position. The second and third nodes of the first switch are connected, and a current path is formed between the first capacitor and the second share line, when the first switch is in a second position. The first and third nodes of the second switch are connected, and a current path is formed between the second capacitor and the second share line when the second switch is in a first position. The second and third nodes of the second switch are connected, and a current path is formed between the second capacitor and the first share line, when the second switch is in a second position.

According to another aspect of the present invention, there is provided a source driver output circuit of a thin film transistor (TFT) liquid crystal display (LCD), comprising first through n-th voltage generators, first through n-th switching portions, first through n-th sub switching portions, and a share-line voltage circuit. The first through n-th voltage generators receive first through n-th corresponding input voltages and generate first through n-th sub input voltages. The first through n-th switching portions transfer the first through n-th sub input voltages as first through n-th corresponding output voltages when activated and disconnect the first through n-th sub input voltages when deactivated. The first through n-th sub switching portions connect share lines to the first through n-th output voltages when activated and disconnect the share lines when deactivated. The share lines include a first share line and a second share line. The first and second share lines have share line voltages during operation. The share-line voltage circuit maintains the share line voltages equally at an intermediate voltage level that is between the share line voltages.

In one embodiment, the share-line voltage circuit comprises a first switch, a first capacitor, a second switch, a second capacitor, a third switch, and a fourth switch. The first switch is coupled between the first share line and a first node. The first capacitor is coupled between the first node and a reference voltage. The second switch is coupled between the second share line and a second node. The second capacitor is coupled between the second node and the reference voltage. The third switch is coupled between the first node and the second share line. The fourth switch is coupled between the second node and the first share line.

In another embodiment, the current path is formed between the first capacitor and the first share line when the first switch is in a closed position. A current path is formed between the first capacitor and the second share line when the third switch is in a closed position. A current path is formed between the second capacitor and the second share line when the second switch is in a closed position. A current path is formed between the second capacitor and the first share line when the fourth switch is in a closed position. The third and fourth switches are in an open position when the first and second switches are in a closed position. The third and fourth switches are in the closed position when the first and second switches are in the open position.

Accordingly, in the source driver output circuit according to the present invention, a slew rate of a signal that is input to the panel from the source driver can be improved through application of the first and second voltages or first and second external voltages, and current consumption in the source driver can be reduced.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF PREFERRED EMBODIMENTS

Figure 1:
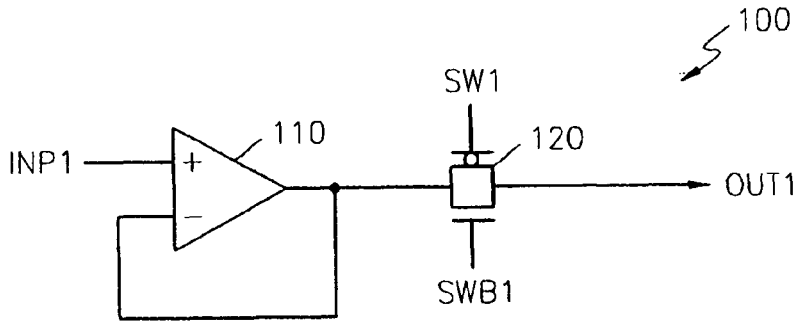
FIG. 1 (PRIOR ART)
FIG. 1 illustrates a conventional source driver output circuit.
Figure 2:
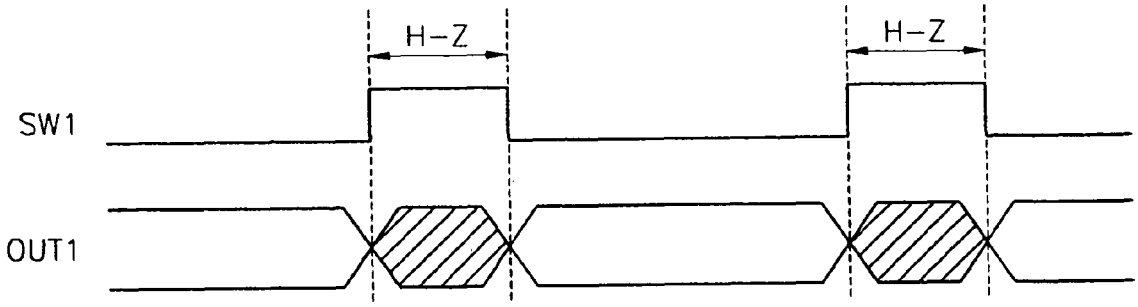
FIG. 2 (PRIOR ART)
FIG. 2 is a timing diagram of the operation of the source driver output circuit of FIG. 1.

Hereinafter, the present invention will be described in detail by describing preferred embodiments of the invention with reference to the accompanying drawings. Like reference numerals refer to like elements throughout the drawings.

Figure 4:
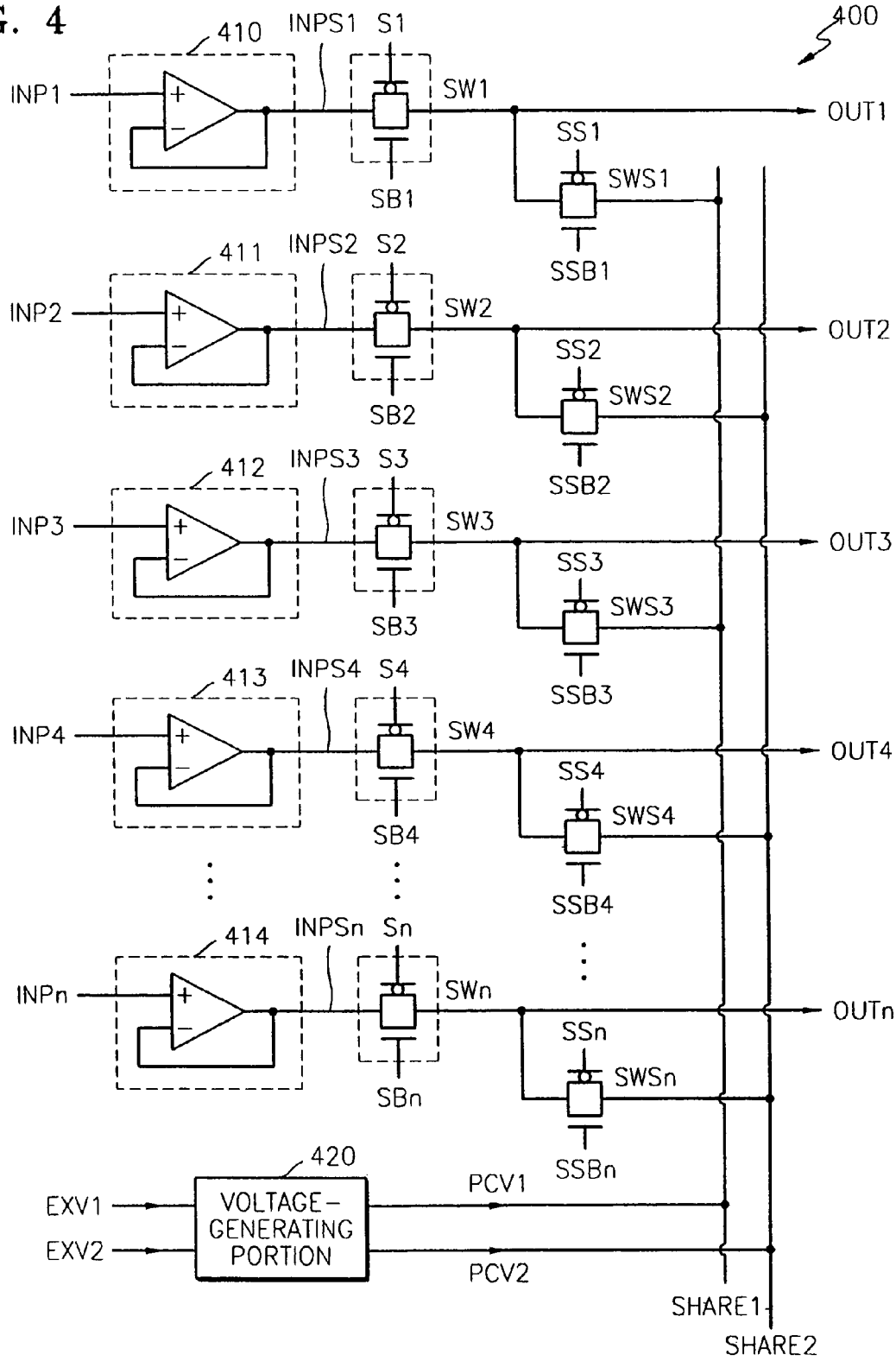
FIG. 4 illustrates a source driver output circuit according to the present invention.
Figure 5:
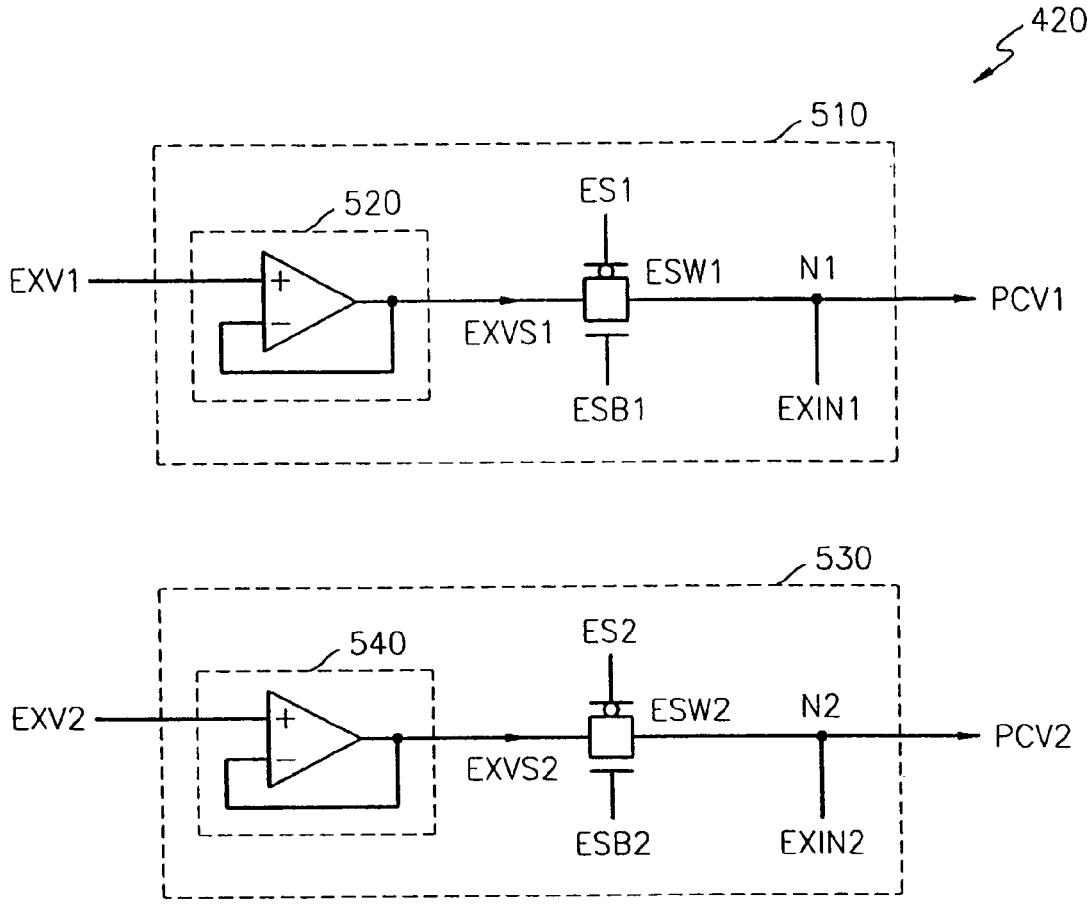
FIG. 5 illustrates a voltage-generating portion of FIG. 4 according to an embodiment of the present invention.

FIG. 4 illustrates a source driver output circuit according to the present invention, and FIG. 5 illustrates a voltage-generating portion of FIG. 4.

Referring to FIGS. 4 and 5, a source driver output circuit 400 according to a first embodiment of the present invention includes first through n-th voltage generators 410, 411, 412, 413, and 414, and first through n-th switching portions Sw1 and SW2~SWn, first through n-th sub switching portions SWS1 and SWS2~SWSn, and a voltage-generating portion 420.

The first through n-th voltage generators 410, 411, 412, 413, and 414 receive first through n-th corresponding input voltages INP1 and INP2~INPn and generate first through n-th sub input voltages INPS1 and INPS2~INPSn. The first through n-th switching portions SW1 and SW2~SWn generate the first through n-th sub input voltages INPS1 and INPS2~INPSn as first through n-th corresponding output voltages OUT1 and OUT2~OUTn when activated, or else cut off the first through n-th sub input voltages INPS1 and INPS2~INPSn when deactivated.

The first through n-th sub switching portions SWS1 and SWS2~SWSn connect predetermined share lines SHARE1 and SHARE2 to the first through n-th output voltages OUT1 and OUT2~OUTn when activated, or else cut off the predetermined shared lines SHARE1 and SHARE2 when deactivated. More specifically, the first through n-th sub switching portions SWS1 and SWS2~SWSn are turned on when the first through n-th corresponding switching portions SW1 and SW2~SWn are turned off.

The share lines SHARE1 and SHARE2 are characterized by two independent lines. For example, odd-numbered output voltages OUT1 and OUT3~OUTn−1 among the first through n-th output voltages OUT1 and OUT2~OUTn are connected to a first share line SHARE1 of the share lines SHARE1 and SHARE2, and even-numbered output voltages OUT2 and OUT4~OUTn are connected to a second share line SHARE2 of the share lines SHARE1 and SHARE2.

The voltage-generating portion 420 receives first and second predetermined voltages EXV1 and EXV2 and applies predetermined precharge voltages PCV1 and PCV2 to the share lines SHARE1 and SHARE2.

In greater detail, with reference to FIG. 5, the voltage-generating portion 420 includes a first precharge voltage-generating part 510 that receives the first voltage EXV1, generates the first precharge voltage PCV1 and applies the first precharge voltage PCV1 to the first share line SHARE1, and a second precharge voltage-generating part 530 that receives the second voltage EXV2, generates the second precharge voltage PCV2 and applies the second precharge voltage PCV2 to the second share line SHARE2.

The first precharge voltage-generating part 510 includes a first sub voltage generator 520 that receives the first voltage EXV1 and generates a first sub voltage EXVS1, and a first precharge switch ESW1 that generates the first sub voltage EXVS1 as the first precharge voltage PCV1 when activated, and cuts off the first sub voltage EXVS1 when deactivated. The first precharge switch ESW1 is turned on when odd-numbered switching portions SW1 and SW3 through SWn−1 among the first through n-th switching portions SW1 and SW2~SWn are turned off. The first sub voltage generator 520 is an amplifier in the form of a voltage follower, and the first voltage EXV1 has a predetermined voltage level, or the level of the first voltage EXV1 is varied when levels of odd-numbered input voltages INP1 and INP3~INPn−1 among the first through n-th input voltages INP1 and INP2~INPn are varied.

The first precharge voltage-generating part 510 applies a first predetermined external voltage EXIN1 to a first node N1 between the first precharge switch ESW1 and the first share line SHARE1. The first external voltage EXIN1 has a predetermined voltage level and is externally applied. The first external voltage EXIN1 is applied when the first precharge switch ESW1 is turned off.

The second precharge voltage-generating part 530 includes a second sub voltage generator 540 that receives a second voltage EXV2 and generates a second sub voltage EXVS2, and a second precharge switch ESW2 that generates the second sub voltage EXVS2 as the second precharge voltage PCV2 when activated, or cuts off the second sub voltage EXVS2 when deactivated. The second sub voltage generator 540 is an amplifier in the form of a voltage follower. The second precharge switch ESW2 is turned on when even-numbered switching portions SW2 and SW4~SWn among the first through n-th switching portions SW1 and SW2~SWn are turned off.

The second precharge voltage-generating part 530 applies a predetermined second external voltage EXIN2 to a second node N2 between the second precharge switch ESW2 and the second share line SHARE2. The second external voltage EXIN2 has a predetermined voltage level and is externally applied. The second external voltage EXIN2 is applied when the second precharge switch ESW2 is turned off. The second voltage EXV2 has a predetermined voltage level, or the level of the second voltage EXV2 is varied when levels of even-numbered input voltages INP2 and INP4~INPn among the first through n-th input voltages INP1 and INP2~INPn are varied.

The source driver output circuit 400 of the TFT LCD according to a second embodiment of the present invention includes first through n-th voltage generators 410, 411, 412, 413, and 414, and first through n-th switching portions SW1 and SW2~SWn, first through n-th sub switching portions SWS1 and SWS2~SWSn, and a voltage-generating portion 420.

In the second embodiment, as in the first embodiment, the first through n-th voltage generators 410, 411, 412, 413, and 414 receive first through n-th corresponding input voltages INP1 and INP2~INPn and generate first through n-th sub input voltages INPS1 and INPS2~INPSn. The first through n-th switching portions SW1 and SW2~SWn generate the first through n-th sub input voltages INPS1 and INPS2~INPSn as first through n-th corresponding output voltages OUT1 and OUT2~OUTn when activated, or cut off the first through n-th sub input voltages INPS1 and INPS2~INPSn when deactivated. The first through n-th sub switching portions SWS1 and SWS2~SWSn connect predetermined share lines SHARE1 and SHARE2 to the first through n-th output voltages OUT1 and OUT2~OUTn when activated or cut off the share lines SHARE1 and SHARE2 when deactivated.

Preferably, the share lines SHARE1 and SHARE2 comprise first and second share lines SHARE1 and SHARE2. Odd-numbered output voltages OUT1 and OUT3~OUTn−1 among the first through n-th output voltages OUT1 and OUT2~OUTn are connected to the first share line SHARE1, and even-numbered output voltages OUT2 and OUT4~OUTn among the first through n-th output voltages OUT1 and OUT2~OUTn are connected to the second share line SHARE2.

In the second embodiment, instead of including a voltage generating portion 420, the first external voltage EXV1 is applied to the first share line SHARE1. The first external voltage EXV1 has a predetermined voltage level and is externally applied. Also, the second external voltage EXV2 is applied to the second share line SHARE2. The second external voltage EXV2 has a predetermined voltage level and is externally applied.

The operation of the source driver output circuit 400 of the TFT LCD according to the first embodiment of the present invention will now be described in detail with reference to FIGS. 4 and 5.

The source driver of a traditional TFT LCD includes a plurality of voltage generators 410, 411, 412, 413, and 414; for example the number of generators can be 384, 402, 420, 480, and 520, the number of generators being determined according to the size of a panel.

In the first embodiment of the present invention, a voltage follower is used as a voltage generator. This is the reason the voltage follower has the same voltage level as an input voltage and generates an output voltage having a higher current capacity level.

A number (n) of the voltage generators 410, 411, 412, 413, and 414 are configured as shown, and a number (n) of the switching portions SW1 and SW2~SWn are configured as shown.

In a case where the switching portions SW1 and SW2~SWn are turned on, the sub input voltages INPS1 and INPS2~INPSn that are generated in the voltage generators 410, 411, 412, 413, and 414 are generated as the output voltages OUT1 and OUT2~OUTn. The first switching portion SW1 is comprised of a PMOS transistor that is turned on or off by applying a first control signal S1 to a gate, and a NMOS transistor that is turned on or off by applying a first inverted control signal SB1 to a gate. When the level of the first input voltage INP1 is rapidly varied, the first control signal S1 is generated at a high level, and the first switching portion SW1 is turned off. When the first input voltage INP1 is maintained at a predetermined level, the first control signal S1 is generated at a low level, and the first switching portion SW1 is turned on, and thus a first sub input voltage INPS1 is generated as a first output voltage OUT1. The structure and operation of the first switching portion SW1 are similarly applied to the other second through n-th switching portions SW2 and SW3~SWn.

The first through n-th sub switching portions SWS1 and SWS2~SWSn connect the first and second lines SHARE1 and SHARE2 to the output voltages OUT1 and OUT2~OUTn. The first through n-th sub switching portions SWS1 and SES2~SWSn are turned on when the first through n-th switching portions SW1 and SW2~SWn are turned off. That is, in a case where the first through n-th switching portions SW1 and SW2~SWn are turned off and the input voltages INP1 and INP2~INPn are not connected to the output voltages OUT1 and OUT2~OUTn, the first through n-th sub switching portions SWS1 and SWS2~SWSn are turned on, and the first and second share lines SHARE1 and SHARE2 are connected to the output voltages OUT1 and OUT2~OUTn.

The first through n-th sub switching portions SWS1 and SWS2~SWSn are comprised of a PMOS transistor and a NMOS transistor that are controlled according to sub control signals SS1 and SS2~SSn and inverted sub control signals SSB1 and SSB2~SSBn.

Input voltages INP1 and INP2~INPn having high levels are input once and then input voltages INP1 and INP2~INPn having low levels are input once. Variation in the levels of odd-numbered input voltages INP1 and INP3~INPn−1 and even-numbered input voltages INP2 and INP4~INPn is in the opposite order. For example, when the odd-numbered input voltages INP1 and INP3~INPn−1 are input as high levels, the even-numbered input voltages INP2 and INP4~INPn−1 are input as low levels. In the case where the odd-numbered switching portions SW1 and SW3~SWn are turned off, a voltage that is charged to the first share line SHARE1 is applied to the panel (not shown), and thereby the panel is charged at a predetermined voltage level. Then, when the odd-numbered switching portions SW1 and SW3~SWn are turned on, the odd-numbered input voltages INP1 and INP3~INPn−1 are applied to the panel. In such a case, a capacitor of the panel is charged at a predetermined voltage level, and thus the panel remains fully charged, and thereby the speed at which an image can be displayed is improved.

Similarly, in the case where the even-numbered switching portions SW2 and SW4~SWn are turned off, a voltage that is charged to the second share line SHARE2 is applied to the panel (not shown), and thereby the panel is charged at a predetermined voltage level. When the even-numbered switching portions SW2 and SW4~SWn are turned on, the even-numbed input voltages INP2 and INP4~INPn are applied to the panel. In such a case, a capacitor of the panel is charged at a predetermined voltage level, and thus, the panel remains fully charged, and thereby the speed at which an image can be displayed is improved.

The two share lines SHARE1 and SHARE2 such as the first share line SHARE1 that is connected to the odd-numbed output voltages OUT1 and OUT3~OUTn−1 and the second shared line SHARE2 that is connected to the even-numbed output voltages OUT2 and OUT4~OUTn, are employed in the first embodiment.

The voltage-generating portion 420 for supplying a voltage for charging the share lines SHARE1 and SHARE2 to a predetermined voltage will now be described with reference to FIG. 5.

The voltage-generating portion 420 includes the first precharge voltage-generating part 510 that receives the first voltage EXV1, generates the first precharge voltage PCV1 and applies the first precharge voltage PCV1 to the first share line SHARE1, and the second precharge voltage-generating part 530 that receives the second voltage EXV2, generates the second precharge voltage PCV2 and applies the second precharge voltage PCV2 to the second share line SHARE2.

The first voltage EXV1 and the second voltage EXV2 that are applied to the first precharge voltage-generating portion 510 and the second precharge voltage-generating portion 530, respectively, serve to charge the first share line SHARE1 and the second shared line SHARE2 to predetermined voltage levels. The first voltage EXV1 and the second voltage EXV2 may be, for example, predetermined voltages. In this case, the first share line SHARE1 is maintained at the level of the first predetermined voltage EXV1, and the second share line SHARE2 is maintained at the level of the second predetermined voltage EXV2.

In addition, the first voltage EXV1 may be varied according to voltage levels of the odd-numbered input voltages INP1 and INP3~INPn−1. That is, when the odd-numbered input voltages INP1 and INP3~INPn−1 are generated as high voltages, the first voltage EXV1 is input as a high voltage that has a different level than the levels of the odd-numbered input voltages INP1 and INP3~INPn−1, and when the odd-numbed input voltages INP1 and INP3~INPn−1 are generated as low voltages, the first voltage EXV1 is input as a low voltage that has a different level than the levels of the odd-numbered input voltages INP1 and INP3~INPn−1. In such a case, since capacitors of the panel (not shown) are previously charged to a degree that the levels of the odd-numbered input voltages INP1 and INP3~INPn−1 are varied, the speed for displaying an image on the screen may be faster than the speed for fixing the level of the first voltage EXV1.

Similarly, the second voltage EXV2 may be varied according to the levels of the varied, even-numbered input voltages INP2 and INP4~INPn. That is, when the even-numbered input voltages INP2 and INP4~INPn are generated as high voltages, the second voltage EXV2 is input as a high voltage that has a different level than the levels of the even-numbered input voltages INP2 and INP4~INPn, and when the even-numbered input voltages INP2 and INP4~INPn are generated as low voltages, the second voltage EXV2 is input as a low voltage that has a different level than the levels of the even-numbered input voltages INP2 and INP4~INPn. In such a case, since the capacitors of the panel (not shown) are previously charged to a degree that the levels of the even-numbered input voltages INP2 and INP4~INPn are varied, the speed for displaying an image on the screen may be faster than the speed for fixing the level of the second voltage EXV2.

The first and second sub voltage generators 520, 540 may comprise amplifiers in the form of voltage followers.

The first and second sub voltages EXVS1 and EXVS2 are transferred to the first and second share lines SHARE1 and SHARE2 through the first and second precharge switches ESW1 and ESW2. The structure of the first and second precharge switches ESW1 and ESW2 is, for example, the same as that of the first through n-th switching portions SW1 and SW2~SWn or the first through n-th sub switching portions SWS1 and SWS2~SWSn.

Precharge switch control signals ES1 and ES2 and inverted precharge switch control signals ESB1 and ESB2 serve to turn on or off the PMOS transistor and the NMOS transistor of the first and second precharge switches ESW1 and ESW2. The first precharge switch ESW1 is turned on when the odd-numbered switching portions SW1 and SW3~SWn−1 among the first through n-th switching portions SW1 and SW2~SWn are turned off. The second precharge switching portion ESW2 is turned on when the even-numbered switching portions SW2 and SW4~SWn among the first through n-th switching portions SW1 and SW2~SWn are turned off. Thus, the inverted precharge switch control signals ESB1 and ESB2 have a phase relation opposite to that of the control signals S1 and S2~Sn for controlling the first through n-th switching portions SW1 and SW2~SWn.

That is, when the levels of the input voltages INP1 and INP2~INPn are rapidly varied, the first through n-th switching portions SW1 and SW2~SWn are turned off, and the first and second precharge switches ESW1 and ESW2 are turned on. Then, the first and second voltages EXV1 and EXV2 are applied to the first and second share lines SHARE1 and SHARE2, respectively, such that voltage levels of the first and second share lines SHARE1 and SHARE2 are maintained at predetermined voltage levels, that is, a first voltage level and a second voltage level, respectively.

The first precharge voltage-generating portion 510 applies the first external voltage EXIN1 to the first node N1 between the first precharge switch ESW1 and the first share line SHARE1. The first external voltage EXIN1 has a predetermined voltage level for charging the first share line SHARE1 and is applied from an external source. In a case where the first sub voltage generator 520 and the first precharge switch ESW1 are not used, the first external voltage EXIN1 is applied so that a voltage level of the first share line SHARE1 is maintained at a predetermined voltage level, that is, a voltage level of the first external voltage EXIN1. In a case where the first sub voltage generator 520 and the first precharge switch ESW1 are used, the first node N1 is floated. A method using the first external voltage EXIN1 has the same effect as that in a case where the first voltage EXV1 is maintained at a predetermined level.

Similarly, the second precharge voltage-generating portion 530 applies the second external voltage EXIN2 to the second node N2 between the second precharge switch ESW2 and the second share line SHARE2. The second external voltage EXIN2 has a predetermined voltage level for charging the second share line SHARE2 and is applied from an external source. In a case where the second sub voltage generator 540 and the second precharge switch ESW2 are not used, the second external voltage EXIN2 is applied so that a predetermined voltage is applied to the second share line SHARE2. In a case where the second sub voltage generator 540 and the second precharge switch ESW2 are used, the second node N2 is floated. A method using the second external voltage EXIN2 has the same effect as that in a case where the second voltage EXV2 is maintained at a predetermined level.

Hereinafter, the operation of the source driver output circuit according to the present invention will be described.

A case of the first embodiment, namely, where the first and second share lines SHARE1 and SHARE2 are charged using the first voltage EXV1 and the second voltage EXV2 will be first described.

The first through n-th input voltages INP1 and INP2~INPn having predetermined levels are applied to the source driver output circuit, and the first through n-th switching portions SW1 and SW2~SWn are connected to the source driver output circuit. In such a case, the first through n-th sub switching portions SWS1 and SWS2~SWSn and the first and second precharge switches ESW1 and ESW2 are turned off, and the first node N1 and the second node N2 are in a floated state. Then, the first though n-th input voltages INP1 and INP2~INPn are applied as the first through n-th output voltages OUT1 and OUT2~OUTn to the panel (not shown).

During operation, the levels of the input voltages INP1 and INP2~INPn are rapidly varied, and thereby the first through n-th switching portions SW1 and SW2~SWn are turned off, and the first through n-th sub switching portions SWS1 and SWS2~SWSn are turned on. When the first and second precharge switching portions ESW1 and ESW2 are turned on in the state where the first and second nodes N1 and N2 are continuously floated, the first voltage EXV1 and the second voltage EXV2 are applied to the first and second share lines SHARE1 and SHARE2.

Figure 3:
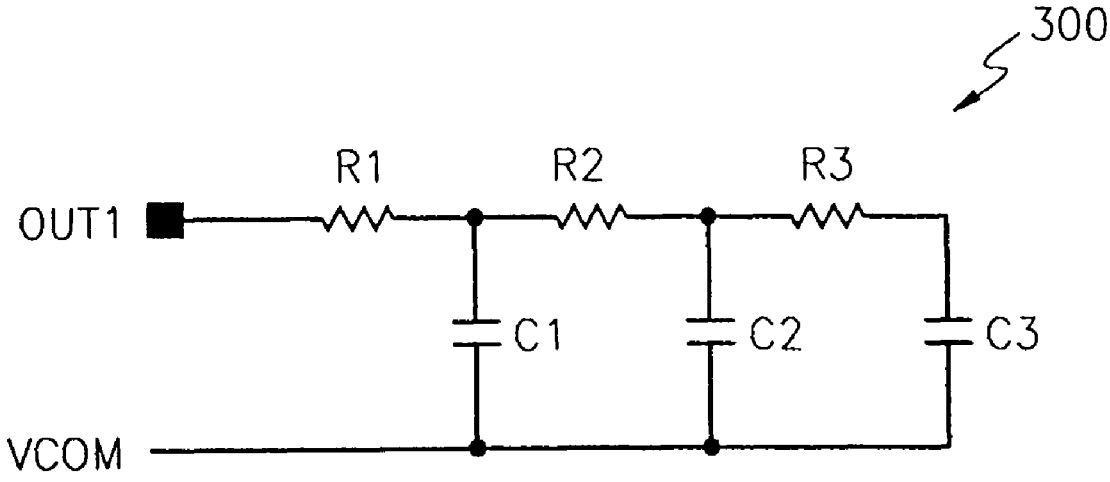
FIG. 3 (PRIOR ART)
FIG. 3 is a circuit model of a panel of a thin film transistor (TFT) liquid crystal display (LCD) that is connected to an output voltage OUT1.

In such a case, since the panel 300 shown in FIG. 3 is connected to the first through n-th output voltages OUT1 and OUT2~OUTn, respectively, the predetermined levels of the first and second share lines SHARE1 and SHARE2 are applied to the panel that is connected to the first through n-th output voltages OUT1 and OUT2~OUTn, and thereby the capacitors of the panel are charged or discharged.

Following this, the first through n-th switching portions SW1 and SW2~SWn are turned on, and the first through n-th input voltages INP1 and INP2~INPn are generated as the first through n-th output voltages OUT1 and OUT2~OUTn and are applied to the panel. Then, first through n-th input voltages INP1 and INP2~INPn are added to voltages that are stored in the capacitors of the panel at predetermined levels. Thus, in a case where the voltage of the capacitor must be increased from 0V to a predetermined voltage, the voltage of the capacitor is faster increased to a required level by means of the voltage having a predetermined level existing in the capacitor. That is, the voltage of the capacitor is increased to a level required for a small amount of current and a fast slew rate.

Now, a case of the second embodiment; namely, where the first and second share lines SHARE1 and SHARE2 are charged using the first external voltage EXIN1 and the second external voltage EXIN2, will be described.

In such a case, the first and second precharge switching portions ESW1 and ESW2 are always turned off. When the first through n-th switching portions SW1 and SW2~SWn are turned off, the first and second external voltages EXIN1 and EXIN2 are applied to the first and second nodes N1 and N2, respectively, and the levels of the first and second share lines SHARE1 and SHARE2 are increased or decreased to the levels of the first and second external voltages EXIN1 and EXIN2. The voltages of the first and second share lines SHARE1 and SHARE2 are applied to transistors of the panel (not shown) through the above operations, and thereby the associated capacitors are charged at predetermined voltage levels.

The source driver output circuit of the TFT LCD according to the second embodiment of the present invention is a circuit for adjusting the voltage levels of the first and second share lines SHARE1 and SHARE2 only through the first and second external voltages EXIN1 and EXIN2.

With the exception that there is no voltage generating portion 420, the source driver output circuit of the TFT LCD according to the second embodiment of the present invention has the same structure and performs the same operation as that of the source driver output circuit 400 of the TFT LCD according to the first embodiment of the present invention. Thus, a detailed description of the operation of the source driver output circuit of the TFT LCD according to the second embodiment of the present invention will be omitted.

Figure 6:
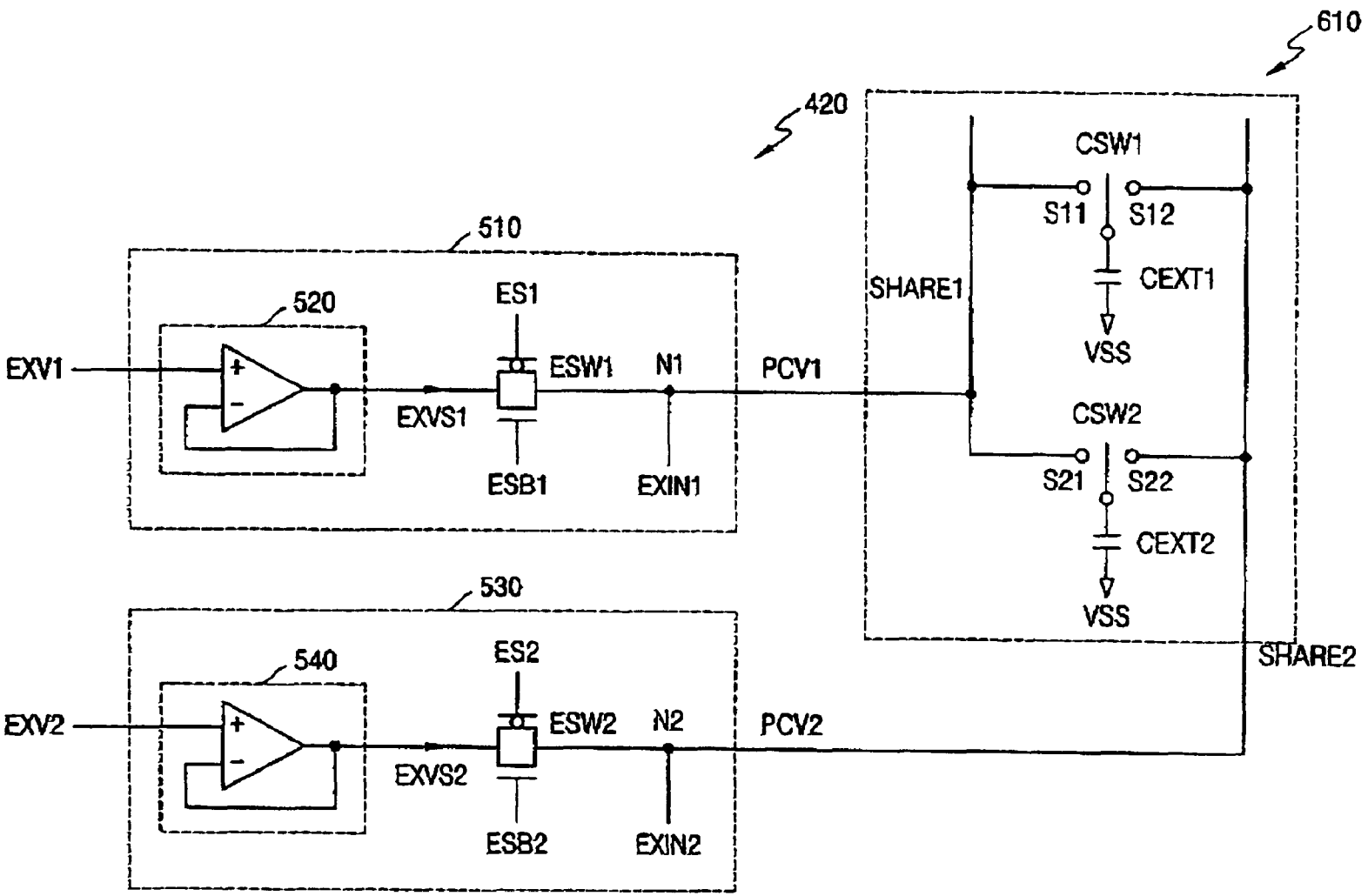
FIG. 6 illustrates a voltage-generating portion according to another embodiment of the present invention.

FIG. 6 illustrates a voltage-generating portion according to another embodiment of the present invention.

When the source driver output circuit 400 of FIG. 4 operates, if one of the first and second share lines SHARE1, SHARE2 has a high voltage level, the other of the first and second share lines SHARE1, SHARE2 has a low voltage level. For example, when the first share line SHARE1 has a high voltage level, the second share line SHARE2 has a low voltage level.

With reference to the embodiment of FIG. 6, a share line pre-charge circuit 610 is shown including a first capacitor CEXT1 coupled between a reference voltage VSS and one of the first and second share lines SHARE1, SHARE2 by a first capacitor switch CSW1, and a second capacitor CEXT2 coupled between the reference voltage VSS and one of the first and second share lines SHARE1, SHARE2 by a second capacitor switch CSW2. In one embodiment, the first and second capacitor switches CSW1, CSW2 comprise conventional transistors that perform a switching function. In the embodiment of FIG. 6, at the start of operation of the first and second precharge voltage-generating parts 510 and 530, the first capacitor switch CSW1, when in a first position, is connected to a node S11, the node S11 in turn connected to the first share line SHARE1. The second capacitor switch CSW2, when in a first position, is connected to a node S22 that in turn is connected to a second share line SHARE2. Alternatively, the first capacitor switch CSW1, when in a second position, is connected to a node S12 that in turn is connected to the second share line SHARE2. The second capacitor switch CSW2, when in a second position, is connected to a node S21 that, in turn, is connected to the first share line SHARE1. In this manner, the presence and operation of capacitors CEXT1, CEXT2 permit voltages of the first share line SHARE1 and second share line SHARE2 to be maintained equally at an intermediate voltage level that is between the voltage levels of the first share line SHARE1 and the second share line SHARE2.

In this embodiment, first and second externally applied voltages EXV1, EXV2 are applied in a similar manner as applied to the voltage generating portion 420 of the source driver output circuit 400, as illustrated in FIG. 4. In this manner, the present embodiment, which utilizes capacitors CEXT1, CEXT2, leads to reduced charging time and power consumption as compared to the case of the embodiment of FIGS. 4 and 5 above, where first and second share lines SHARE1, SHARE2 are charged to predetermined voltage levels using the first and second externally applied voltage signals EXV1, EXV2 without the capacitors CEXT1, CEXT2.

As described above, in the source driver output circuit of the TFT LCD according to the present invention, a slew rate of a signal that is input to the panel from the source driver can be improved through the application of the first and second voltages EXV1, EXV2 or first and second external voltages EXIN1, EXIN2, and current consumption in the source driver can be reduced.

Figure 7:
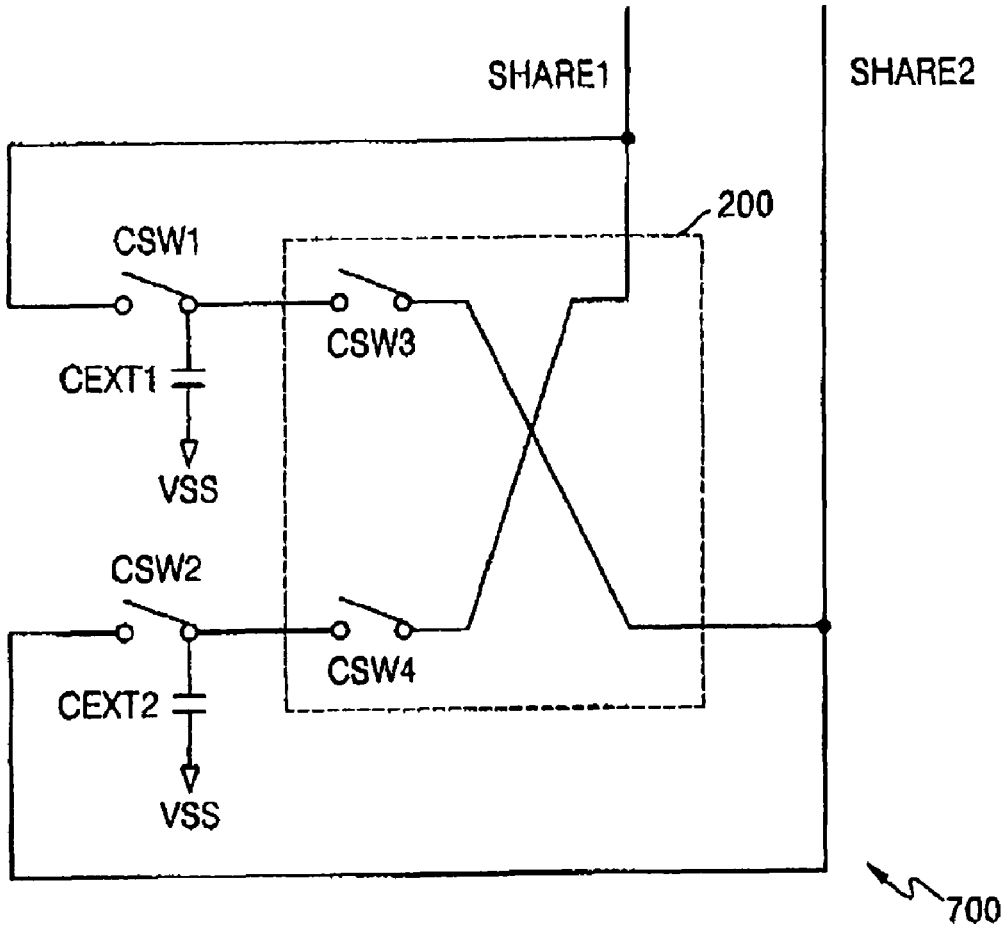
FIG. 7 illustrates a share-line voltage circuit according to another embodiment of the present invention.

FIG. 7 illustrates a share-line voltage circuit 700 according to another embodiment of the present invention. The circuit 700 includes a first switch CSW1 and a third switch CSW3 coupled in series between the first share line SHARE1 and the second share line SHARE2, and a second switch CSW2 and a fourth switch CSW4 coupled in series between the first share line SHARE1 and the second share line SHARE2. A first capacitor CEXT1 is coupled between a reference voltage VSS and a node between the first switch CSW1 and the third switch CSW3. A second capacitor CEXT2 is coupled between the reference voltage VSS and a node between the second switch CSW2 and the fourth switch CSW4. In one embodiment, the first, second, third, and fourth capacitor switches CSW1, CSW2, CSW3, CSW4 comprise conventional transistors that perform a switching function. In a first example of the operation of the circuit 700, it is assumed that the first share line SHARE1 has a high voltage level and the second share line SHARE2 has a low voltage level. In the embodiment illustrated in FIG. 7, switches CSW1, CSW2 are connected when switches CSW3, CSW4 are cut off, whereby the capacitors CEXT1, CEXT2 are charged. Conversely, switches CSW1, CSW2 are cut off when the switches CSW3, CSW4 are connected. In this manner, capacitors CEXT1 and CEXT2 permit voltages of the first share line SHARE1 and second share line SHARE2 to be maintained equally at an intermediate voltage level that is between the voltages of the first share line SHARE1 and the second share line SHARE2. Thus, the first and second share lines SHARE1 and SHARE2 can be maintained at a predetermined voltage level without applying external voltages, for example, voltages EXV1 and EXV2.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A source driver output circuit of a thin film transistor (TFT) liquid crystal display (LCD), the source driver output circuit comprising:

first through n-th (where n is an integer) voltage generators that receive first through n-th corresponding input voltages and generate first through n-th sub input voltages;

first through n-th switching portions that transfer the first through n-th sub input voltages as first through n-th corresponding output voltages to first through n-th corresponding source lines when activated, and disconnect the first through n-th sub input voltages when deactivated; and first through n-th sub switching portions that connect first and second share lines to the first through n-th corresponding source lines when activated and disconnect the first and second share lines when deactivated, the first and second share lines having share line voltages, wherein the first through n-th sub switching portions includes odd-numbered sub switching portions and even-numbered sub switching portions, wherein the odd-numbered sub switching portions of the first through n-th sub switching portions are coupled to the first share line and the even-numbered sub switching portions of the first through n-th sub switching portions are coupled to the second share line, wherein the first share line is coupled to different sub switching portions than the second share line, wherein the odd-numbered sub switching portions are coupled to different source lines than the even-numbered sub switching portions; and a switching circuit that maintains each of the share line voltages at an intermediate voltage level that is between the share line voltages of the first and second share lines, respectively, wherein the switching circuit is coupled directly between the first and second share lines, and transfers charges between the first share line and the second share line.

2. The source driver output circuit of claim 1, wherein odd-numbered output voltages among the first through n-th output voltages are connected to the first share line via the odd-numbered sub switching portions, when activated, and even-numbered output voltages among the first through n-th output voltages are connected to the second share line via the even-numbered sub switching portions, when activated.

3. The source driver output circuit of claim 2 further comprising a voltage-generating portion that receives a first voltage and a second voltage and applies the first voltage and the second voltage to the first and second share lines, respectively, the voltage-generating portion comprising:

a first precharge voltage-generating portion that receives the first voltage, generates a first precharge voltage, and applies the first precharge voltage to the first share line; and a second precharge voltage-generating portion that receives the second voltage, generates a second precharge voltage, and applies the second precharge voltage to the second share line.

4. The source driver output circuit of claim 3, wherein the first precharge voltage-generating portion comprises:

a first sub voltage generator that receives the first voltage and generates a first sub voltage; and a first precharge switch coupled between the first sub voltage generator and the first share line, wherein the first precharge switch outputs the first sub voltage as the first precharge voltage when activated and disconnects the first sub-voltage when deactivated.

5. The source driver output circuit of claim 4, wherein the first precharge switch is activated when odd-numbered switching portions of the first through n-th switching portions are deactivated.

6. The source driver output circuit of claim 4, wherein the first sub voltage generator comprises an amplifier in the form of a voltage follower.

7. The source driver output circuit of claim 4, wherein the first voltage has a predetermined level, and wherein the level of the first voltage is varied when the levels of odd-numbered input voltages among the first through n-th input voltages are varied.

8. The source driver output circuit of claim 3, wherein the second precharge voltage-generating portion comprises:

a second sub voltage generator that receives the second voltage and generating a second sub voltage; and a second precharge switch coupled between the second sub voltage generator and the second share line, wherein the second precharge switch outputs the second sub voltage as the second precharge voltage when activated and disconnects the second sub voltage when deactivated.

9. The source driver output circuit of claim 8, wherein the second precharge switch is activated when even-numbered switching portions of the first through n-th switching portions are deactivated.

10. The source driver output circuit of claim 8, wherein the second sub voltage generator comprises an amplifier in the form of a voltage follower.

11. The source driver output circuit of claim 8, wherein the second voltage has a predetermined level, and wherein the level of the second voltage is varied when the levels of even-numbered input voltages among the first through n-th input voltages are varied.

12. The source driver output circuit of claim 1, wherein the first through n-th sub switching portions are activated when the first through n-th corresponding switching portions are deactivated.

* * * * *